United States Patent [19]

Nakamura et al.

[11] Patent Number: 4,460,626

[45] Date of Patent: Jul. 17, 1984

[54] HEAT-SENSITIVE RECORDING MATERIAL

[75] Inventors: Sukenori Nakamura; Akira Igarashi; Hiroharu Matsukawa, all of Shizuoka, Japan

[73] Assignee: Fuji Photo Film Co., Ltd., Kanagawa, Japan

[21] Appl. No.: 426,060

[22] Filed: Sep. 28, 1982

Related U.S. Application Data

[62] Division of Ser. No. 291,153, Aug. 7, 1981, Pat. No. 4,415,633.

[30] Foreign Application Priority Data

Aug. 12, 1980 [JP] Japan ..... 55-110942

[51] Int. Cl.[3] ..... B41M 5/18

[52] U.S. Cl. ..... 427/150; 427/151; 428/488.1; 346/208; 346/216; 346/214; 346/225

[58] Field of Search ..... 282/27.5; 427/150, 151, 427/152; 428/320.4, 320.6, 320.8, 484, 488, 537, 913, 914, 411

[56] References Cited

U.S. PATENT DOCUMENTS 4,236,732 12/1980 Murakami et al. ..... 282/27.5

*Primary Examiner*—Bruce H. Hess

*Attorney, Agent, or Firm*—Sughrue, Mion, Zinn, Macpeak and Seas

[57] ABSTRACT

A heat-sensitive recording material comprising a heat-sensitive color forming layer on a base is disclosed. The color forming layer contains an electron donating colorless dye and an organic acid to which a heat-fusible substance having a melting point in the range of from 60° to 150° C. is fusion-bonded. A process for producing such recording material by applying to a base a coating solution containing a developer for heat-sensitive recording is also disclosed. The developer is prepared by the steps of dispersing in a dispersion medium a heat-fusible substance having a melting point in the range of from 60° C. to 150° C. and an organic acid, heating the resulting dispersion under conditions that form a turbulent flow, and cooling the heated dispersion to ordinary temperatures.

3 Claims, No Drawings

HEAT-SENSITIVE RECORDING MATERIAL

This is a division of application Ser. No. 291,153, filed Aug. 7, 1981, now U.S. Pat. No. 4,415,633.

FIELD OF THE INVENTION

This invention relates to a heat-sensitive recording material, and more particularly to a heat-sensitive recording material used in high-speed recording heat-sensitive facsimiles.

BACKGROUND OF THE INVENTION

Heat-sensitive recording materials record images by using physical or chemical changes that occur to objects due to thermal energy, and a great number of processes have been studied for these materials. A heat-sensitive recording material that uses a physical change of an object caused by heat has long been known as "wax type" heat-sensitive recording paper. This type of paper is currently used for electrocardiograms or the like. Several color forming mechanisms have been proposed for a heat-sensitive recording material which utilize a heat-induced chemical change, and a typical example is known as "two-component color forming system based heat-sensitive recording sheet". This sheet is made by coating a base with a dispersion of fine particles which include two heat-reactive compounds that are separated from each other by a binder or the like. One or both of the compounds are melted so that they contact each other and cause a color forming reaction by which a record is produced. The two heat-reactive compounds are generally called electron donor and electron acceptor compounds. A great number of combinations of these compounds are known. However, they basically consist of those which form a metal compound image and those which form a dye image.

The two-component color forming system based heat-sensitive recording sheet (1) depends on primary color formation and requires no development step, (2) has a texture similar to that of plain paper and (3) is easy to handle. In addition to these advantages, one which uses a colorless dye as an electron donor compound (4) achieves high color density and (5) permits easy manufacture of heat-sensitive recording sheets forming various hues of color. For these reasons, the two-component color forming system based heat-sensitive recording sheet is most commonly used as heat-sensitive recording material.

The heat-sensitive recording sheet having the unique features described above has recently begun to draw researchers' attention as paper that is suitable for recording the received image in facsimile communications. When a heat-sensitive recording sheet is used as recording paper for a facsimile, no development is needed. Accordingly, a facsimile receiver of simplified construction can be used. The fact that the recording paper is the only consumable is advantage with respect to the maintenance of the equipment. However, the use of such a sheet is disadvantageous in that it relies on thermo-recording and therefore has a slow recording speed. The slow recording speed is due to the slow heat response of the thermo-recording head and the heat-sensitive recording material used. With the recent advance in technology, thermo-recording heads having good heat response characteristics have been developed. However, no heat-sensitive recording material that fully meets this requirement has been devised.

Therefore, one object of this invention is to provide a heat-sensitive recording material having good heat response characteristics that enables high-speed recording. More specifically, the invention intends to provide a heat-sensitive recording material which is distinct from prior art recording material that uses a heat pulse of a width of about 5 ms (milli second). It is an object of this invention to produce a material which achieves satisfactory color density with a heat pulse of a width of less than 2 ms (milli second). To achieve this object, the temperature at which color is formed in the heat-sensitive recording material must be decreased. Conventionally, color is formed at a desired temperature by using a colorless electron donor compound (hereunder referred to as a color former) and an electron acceptor compound (hereunder referred to as a developer) at least one of which has a low melting point. We previously proposed in U.S. patent Ser. No. 58,399 and G.B. 2,033,594 A a developer made of a condensate of phenol and aldehyde. Japanese Patent Publication No. 4160/68 teaches the addition of a heat-fusible substance to a combination of color former and developer that forms color at a desired temperature. The heat-fusible substance is added in order to satisfy all other requirements for a heat-sensitive recording material, e.g., white background, long keeping quality of the color forming system, low cost and good hue of color. This substance must be miscible with either the color former or developer or both when it is melted. Because of its purpose, the heat-fusible substance is generally made of a compound that has a lower melting temperature than the color former and developer. However, in most cases, the recording material forms color at a temperature significantly lower than the melting point of the heat-fusible substance. This is perhaps because the heat-fusible substance forms a partial eutectic mixture with the color former or developer and the melting point of the blend is reduced to the eutectic point. For example, in a system wherein the color former is crystal violet lactone (m.p. 178° C.), the developer is 2,2-bis(p-hydroxyphenylpropane) (m.p. 158° C.) and the heat-fusible substance is stearic acid amide (m.p. 140° C.), the recording material forms color at about 80° C. In this sense, the heat-fusible substance need not be a compound whose melting point is lower than that of both the color former and developer, and any compound that causes a reduction in the melting point can be used.

Although the heat-sensitive recording material described above forms color at a desired low temperature, it possesses a disadvantageous characteristic. For instance, a fairly long heating period is necessary for providing satisfactory color density. The reason is that a heat-sensitive recording material containing a heat-fusible substance forms color by going through the following steps: (1) the melting of the heat-fusible substance, (2) the dissolution of the coupler and developer into the heat-fusible substance, and (3) the color forming reaction between the color former and developer; and step (2) governs the rate of the color forming reaction. Therefore, in spite of its satisfactorily low color forming temperature, the heat-sensitive recording material is still unsatisfactory for use as high-speed heat-sensitive recording material that is in increasing demand these days.

In order to solve this problem, a first method involves minimizing the size of the particles of the color former, developer and the heat-fusible substance. By reducing the particle size, the melting and dissolution speeds are increased making high-speed heat-sensitive recording possible. However, a great deal of energy is required to crush the color former, developer and heat-fusible substance into small particles. In addition, the small particles require the use of an increased amount of binder when applying a coating of the mixture onto a base.

The second method, developed from the first method described above, is characterized by forming a homogeneous mixture of the heat-fusible substance with either the color former, developer or both. Specifically, a uniform melt of the color former or developer and the heat-fusible substance is cooled to a solid. Alternatively, the color former or developer and the heat-fusible substance are dissolved in a solvent, followed by evaporation of the solvent or mixing with a precipitation solvent to form a precipitate. This method is very effective in forming a high-speed heat-sensitive recording material because the time required for the color former or developer to dissolve in the heat-fusible substance can be assumed to be almost zero. However, to provide a uniform mixture, the developer and heat-fusible substance must first be melted and then cooled to a solid before it is crushed and even pulverized. Alternatively, the three ingredients must be dissolved in a large quantity of solvent. All of these procedures are unsuitable for practical application. Furthermore, heat-sensitive recording material prepared by these procedures is likely to fog during handling.

We have made various efforts to devise an alternative process for producing a high-speed heat-sensitive recording material and, as a result, have accomplished this invention.

Therefore, another object of this invention is to provide a simple method for producing a developer that melts at a desired color forming temperature allowing it to enter into a color forming reaction with a color former, as well as a heat-sensitive recording material that uses such a developer.

The objects of this invention, can be achieved by using as a developer for heat-sensitive recording an organic acid having fusion-bonded thereto a heat-fusible substance having a melting point in the range of from 60° C. to 150° C.

DETAILED DESCRIPTION OF THE INVENTION

The term "fusion bonding" as used herein means heating the heat-fusible substance so that it is brought into contact with the developer. According to the two preferred embodiments, the developer is covered with the heat-fusible substance and particles of the heat-fusible substance are dispersed on the surfaces of the developer particles. Specifically, a dispersion medium having a heat-fusible substance dissolved therein is prepared and fine particles of an organic acid are dispersed in the medium. The dispersion is then spray-dried to cause fusion bonding between the heat-fusible substance and the organic acid. Alternatively, a melt or solution of a heat-fusible substance is dropped in the form of a curtain and particles of an organic acid are injected onto the curtain to fusion-bond the two substances. Many other methods are known for causing fusion bonding and they are described in Wolfgang Sliwka, *Angewandte Chemie*, International Edition, Vol. 14, pp. 539–550 (1975), etc. To prepare a developer for heat-sensitive recording paper, a heat-fusible substance having a melting point in the range of from 60° C. to 150° C. and an organic acid having a higher melting point than the heat-fusible substance is dispersed in a water-soluble polymeric dispersion medium. The resulting dispersion is heated under conditions which cause the formation of a turbulent flow. The dispersion is then cooled to ordinary temperatures. This way, an organic acid to which the heat-fusible substance is fusion-bonded is obtained more easily than by the methods described above.

Specific examples of the water-soluble polymer used as the dispersion medium include a synthetic water-soluble polymer such as polyacrylamide, polyvinyl pyrrolidone, polyvinyl alcohol, styrene-maleic anhydride copolymer, ethylene-maleic anhydride copolymer, or isobutylene-maleic anhydride copolymer; a natural water-soluble polymer such as hydroxyethyl cellulose, starch derivative, gelatin or casein; and modified products thereof. These water-soluble polymers are used in the form of an aqueous solution having a concentration of 1 to 20 wt%, preferably 3 to 10 wt%. If the concentration is less than 1 wt%, the dispersed particles are so labile that they are agglomerate during the subsequent heating step. If the concentration is more than 20 wt%, the dispersion medium has such a high viscosity that excessive energy is spent in forming a uniform dispersion.

The organic acid is desirably a compound that is solid at ordinary temperatures and which has a melting point of 80° C. or more. Preferred compounds are phenols and aromatic carboxylic acid derivatives. Preferred phenols include p-octylphenol, p-tert-butylphenol, p-phenylphenol, 1,1-bis(p-hydroxyphenyl)-2-ethylbutane, 2,2-bis(p-hydroxyphenyl)propane, 2,2-bis(p-hydroxyphenyl)pentane, 2,2-bis(p-hydroxyphenyl)hexane, and 2,2-bis(4-hydroxy-3,5-dichlorophenyl)propane. Bisphenols are particularly preferred since they achieve high color density and have fairly good keeping quality. Preferred bisphenols are represented by the formula

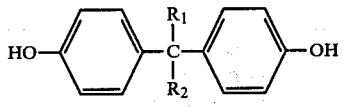

wherein $R_1$ and $R_2$ each represents a hydrogen atom or an alkyl group containing 1 to 12 carbon atoms or $R_1$ and $R_2$ combine to form a carbocyclic ring; or derivatives thereof.

Preferred aromatic carboxylic acid derivatives include p-hydroxybenzoic acid, ethyl p-hydroxybenzoate, butyl p-hydroxybenzoate, 3,5-di-tert-butylsalicylic acid, 3,5-di-α-methylbenzylsalicylic acid, and polyvalent metal salts of free carboxylic acids.

The heat-fusible substance may be a compound that is solid at ordinary temperatures and which when melted is missible with the organic acids described above. A compound having a melting point in the range of from 60° C. to 150° C. is preferred. If the melting point is lower than 60° C., the resulting heat-sensitive recording material forms color and fogs during storage. If the melting point is higher than 150° C., the resulting heat-sensitive recording material often fails to have the color forming temperature required for the high-speed sensitive recording material. In order to achieve better results in fusion bonding, the heat-fusible substance preferably has high miscibility with the organic acid, and a compound that dissolves at least 20 wt% of the organic acid under molten conditions is particularly preferred.

The heat-fusible substance desirably has a lower melting point than the organic acid used as developer. Furthermore, it is preferable if the heat-fusible substance is fusion-bonded to the organic acid at a temperature lower than the melting point of the organic acid. In practice, it is preferable if the two compounds are fusion-bonded at a temperature lower than the melting point of the heat-fusible substance. Specific examples of the heat-fusible substance include higher aliphatic acid amides (e.g., stearic acid amide, palmitic acid amide, erucic acid amide and oleic acid amide), ethylene bis-stearoamide, acetanilide, acetoacetamide and derivatives thereof. Straight chain higher aliphatic acid amides having 12 to 24 carbon atoms are particularly preferred.

The organic acid and heat-fusible substance are generally used in a weight ratio in the range of from 10:1 to 1:5, preferably from 5:1 to 1:2. They are put into an aqueous solution of water-soluble polymer in a solid content of 5 to 40 w/v % and are dispersed by a propeller stirrer, homogenizer, dissolver or other suitable means. The dispersed particles may be of any size unless they are excessively large. Specifically, the dispersed particles should have a volume average size of several millimeters, preferably less than one millimeter.

The dispersion is then heated while it is stirred with a disperser to give a shear (stirring) sufficient to form a turbulent flow. The temperature to which the dispersion is heated varies with the type of organic acid and heat-fusible substance. In general, a temperature lower than the melting point of the heat-fusible substance will serve the purpose. Subsequently, the dispersion is quenched to room temperature with cold water or by other suitable means. When the dispersion is agitated by a propeller stirrer having relatively low dispersing ability, developer particles having a size of 10 to 30 μm are produced. If a dissolver or other machine having great dispersing ability is used, a particle size of 3 to 10 μm is obtained. When observed under a scanning electron microscope, the dispersed particles thus-produced look entirely different from the particles obtained by dispersing either the developer or heat-fusible substance alone.

The method of this invention provides a large quantity of dispersion in a very short period of time as compared with the method of using a ball mill, sand mill, etc. The dispersion obtained is highly stable and the dispersed particles will not agglomerate or precipitate upon standing for several days. Another advantage is that the dispersion step is simplified since the developer and heat-fusible substance can be dispersed in a single step.

When the particles of the developer to which the particles of heat-fusible substance are fusion-bonded are large, they may be reduced in size as in the preparation of ordinary heat-sensitive recording papers by a ball mill, sand mill, attritor, colloid mill, or other suitable means. However, if a more powerful dispersing means is used, finely dispersed particles as small as several microns in size can be produced in a single step, so no separate pulverizing step is required. Accordingly, a desired dispersion can be prepared in a period of time that is from several tens to several times shorter than has been required in preparing the conventional coating solution for heat-sensitive recording material. Any developer particle having a particle size of 10 μm or less prepared in this manner exhibits satisfactory performance for use as a component of high-speed heat-sensitive recording material. Furthermore, they need not be further reduced in size.

To prepare the heat-sensitive recording material of this invention, the developer having the heat-fusible substance fusion-bonded thereto that has been produced by the novel method described above is blended with a color former, inorganic or organic oil-absorbing pigment, binder. Other ingredients which may be added include a release agent, an agent such as a binder that makes the recording material waterproof, a UV absorber, wax and a dispersant. A coating of the mixture is applied onto a base.

Typical examples of the color former that can be combined with the developer of this invention include (1) triarylmethanes, (2) diphenylmethanes, (3) xanthenes, (4) thiazines, and (5) spiropyran compounds. Specific examples are given in U.S. patent Ser. No. 58,399 and G.B. 2,033,594 A. Many of the compounds of the groups (1) and (3) achieve high color density and hence are preferred. These color formers may be used individually or in admixture. The color former is generally dispersed by a ball mill or the like in an aqueous solution of the water-soluble polymers described above. The dispersion of fine particles of the color former is then mixed with the dispersion of the developer to which the heat-fusible substance has been fusion-bonded. The color former is mixed with the developer in a ratio of from 1:20 to 1:1, preferably from 1:5 to 1:2.

A preferred inorganic or organic oil-absorbing pigment is such that it absorbs at least 50 ml of oil per 100 g as measured in accordance with JIS K5101. Specific examples include kaolin, calcined kaolin, talc, pyrophyllite, diatomaceous earth, calcium carbonate, aluminum hydroxide, magnesium hydroxide, magnesium carbonate, titanium oxide, barium carbonate, urea-formalin filler and cellulose filler.

The coating solution thus formed is spread on paper, plastic or other suitable bases and dried. The coating amount of the solution is from 0.1 $g/m^2$ to 0.7 $g/m^2$, preferably from 0.2 $g/m^2$ to 0.5 $g/m^2$ in terms of the weight of the color former.

This invention is now described in greater detail by reference to the following examples which are given here for illustrative purposes only and are by no means intended to limit the scope of the invention.

EXAMPLE 1

A mixture of 10 g of 2,2-bis(p-hydroxyphenyl)propane and 10 g of stearic acid amide was put in 100 g of a 5% aqueous solution of polyvinyl alcohol (degree of polymerization=500, saponification value=98%) and the resulting dispersion was heated to 85° C. under vigorous agitation with a propeller mixer. After the dispersion was held at 85° C. for 10 minutes, it was cooled to room temperature. When the dispersion was heated to 85° C., it turned milk white and the particles of 2,2-bis(p-hydroxyphenyl)propane could not be clearly distinguished from those of stearic acid amide. The melting point of 2,2-bis(p-hydroxyphenyl)propane was 158° C. and its average particle size was 180 μm, and the melting point of stearic acid amide was 140° C. and its average particle size was 110 μm. In contrast, the developer consisting of the fusion-bonded particles of 2,2-bis(p-hydroxyphenyl)propane and stearic acid amide had a melting point of 87° C. and an average particle size of 18 μm. The dispersion was stirred with a ball mill for 5 hours to provide dispersed particles having an average size of 6 μm. Separately from the developer, a color former was prepared by stirring a dispersion of 3 g of crystal violet lactone in 15 g of 5% polyvinyl alcohol in a ball mill for 24 hours until the dispersed particles of the lactone had an average size of 3 μm. The developer and color former dispersions were mixed and to the mixture, 20 g of calcium carbonate powder and 100 g of 5% aqueous polyvinyl alcohol solution were added to make a heat-sensitive coating solution. The solution was spread on raw paper (basic weight=50 g/m$^2$) to give a coating weight of 5 g/m$^2$, dried and calendered under a pressure of 10 kgw/cm at a speed of 1 m/sec. Recording was made on the resulting heat-sensitive paper with an exothermic recording head adjusting in order to apply a power of 25 w/mm$^2$ at a pulse width of 1.5 ms (milli second) and 3.0 ms (milli second). The density of the background before the recording and the color density after the recording were measured with a Macbeth RD-514 type reflection densitometer (using a visual filter). The recorded image was left to stand in an atmosphere (50° C., 90% RH) for 16 hours, and the density of the background and that of the recorded image were measured. The results are shown in Table 1 below.

EXAMPLE 2

A mixture of 100 g of 2,2-bis(p-hydroxyphenyl)propane and 100 g of palmitic acid amide was put in 1 kg of a 5% aqueous sodium caseinate solution, and the mixture was stirred with a propeller mixer to make a dispersion. After heating to 90° C., the dispersion was further stirred with a dissolver for 10 minutes and then, under continued stirring with the dissolver, the dispersion was quenched by cooling the dispersion vessel. The resulting particles of 2,2-bis(p-hydroxyphenyl)propane to which palmitic acid amide was fusion-bonded had a diameter of 5.5 μm and a melting point of 76° C. Heat-sensitive paper was prepared using this developer according to the procedure of Example 1, and the color density, whiteness of the background and keeping quality of the paper were evaluated as in Example 1. The results are shown in Table 1 below.

COMPARATIVE EXAMPLE 1

(A) A mixture of 10 g of 2,2-bis(p-hydroxyphenyl)propane and 10 g of stearic acid amide was put in 100 g of a 5% aqueous polyvinyl alcohol solution, and stirred in a 300 ml ball mill for 24 hours. The resulting dispersion comprised particles having a volume average size of 6 μm.

(B) The dispersion was stirred for an additional 48 hours to obtain a volume average particle size of 3 μm.

A dispersion of 3 g of crystal violet lactone in 15 g of 5% polyvinyl alcohol was prepared as in Example 1, and added to the dispersions (A) and (B) of 2,2-bis(p-hydroxyphenyl)propane and stearic acid amide, respectively. To each dispersion mixture, 20 g of fine calcium carbonate powder and 100 g of a 5% aqueous polyvinyl alcohol solution were added to make a heat-sensitive coating solution. The solution was spread on raw paper having a basis weight of 50 g/m$^2$, dried and calendered under a pressure of 10 kgw/cm at a speed of 1 m/sec to make heat-sensitive recording paper. The color density, whiteness of the background and keeping quality of the paper were evaluated as in Example 1. The results are shown in Table 1 below.

COMPARATIVE EXAMPLE 2

A mixture of 10 g of 2,2-bis(p-hydroxyphenyl)propane and 10 g of stearic acid amide was put into a glass beaker which was placed in an oil bath at 200° C. fuse the compounds completely. Then the beaker was put into water for quenching. The resulting 1:1 eutectic mixture of 2,2-bis(p-hydroxyphenyl)propane and stearic acid amide was crushed to an average particle size of 300μ and put into 100 g of a 5% aqueous polyvinyl alcohol solution and stirred with a 300 ml ball mill for 24 hours to obtain a dispersion having an average particle size of 6μ. To the dispersion, a dispersion of color former, fine calcium carbonate powder and an aqueous polyvinyl alcohol solution were added as in Example 1 to make a heat-sensitive solution. The solution was spread on raw paper, dried, calendered, had a color formed, and subjected to the measurement of density and keeping quality as in Example 1. The results are shown in Table 1 below.

TABLE 1

| Run No. | Recording Pulse Width (ms (milli second)) | Image Density | Background Density | Keeping Quality Image Density | Keeping Quality Background Density |
|---|---|---|---|---|---|
| Example 1 | 1.5 | 1.31 | 0.08 | 1.20 | 0.10 |
| | 3.0 | 1.35 | | 1.28 | |
| Example 2 | 1.5 | 1.33 | 0.08 | 1.24 | 0.08 |
| | 3.0 | 1.36 | | 1.31 | |
| Comparative Example 1 (A) | 1.5 | 0.67 | 0.08 | 0.33 | 0.10 |
| | 3.0 | 0.96 | | 0.69 | |
| Comparative Example 1 (B) | 1.5 | 1.02 | 0.10 | 0.77 | 0.14 |
| | 3.0 | 1.29 | | 1.17 | |
| Comparative Example 2 | 1.5 | 1.28 | 0.12 | 1.09 | 0.18 |
| | 3.0 | 1.34 | | 1.26 | |

As shown in Table 1, the heat-sensitive recording material according to this invention achieves high color density in high-speed recording, and has a background with a high degree of whiteness that is maintained even in a hot and humid atmosphere. Comparison between the Examples and Comparative Examples shows that a dispersion of developer particles can be obtained by the method of this invention in a period only a fraction of that required by the conventional technique.

While the invention has been described in detail and with reference to specific embodiments thereof, it will be apparent to one skilled in the art that various changes and modifications can be made therein without departing from the spirit and scope thereof.

What is claimed is:

1. A process for producing a heat-sensitive recording material comprising applying to a base a coating solution containing a developer for heat-sensitive recording, said developer being prepared by the steps of:

(a) dispersing in a water medium, (i) a heat-fusible substance having a melting point in the range of from 60° C. to 150° C. and which is miscible with an organic acid, wherein said heat-fusible substance has a lower melting point than said organic acid, and (ii) an organic acid, (b) heating the resulting dispersion at a temperature lower than the melting point of said heat-fusible substance under conditions that form a turbulent flow, and (c) cooling the heated dispersion to ordinary temperatures.

2. A process according to claim 1 wherein said organic acid is at least one compound selected from the group consisting of a phenol, an aromatic carboxylic acid derivative, and a polyvalent metal salt of an aromatic carboxylic acid derivative.

3. A process according to claim 1, wherein said organic acid is 2,2-bis(p-hydroxyphenyl)propane and said heat-fusible substance is a straight chain higher aliphatic acid amide having 14 to 22 carbon atoms.

* * * * *